US007541536B2

(12) United States Patent
Daniel

(10) Patent No.: US 7,541,536 B2
(45) Date of Patent: Jun. 2, 2009

(54) MULTI-SOUND EFFECT SYSTEM INCLUDING DYNAMIC CONTROLLER FOR AN AMPLIFIED GUITAR

(75) Inventor: Shavit Daniel, Modi'in (IL)

(73) Assignee: Guitouchi Ltd., Haifa Bay (IL)

( * ) Notice: Subject to any disclaimer, the term of this patent is extended or adjusted under 35 U.S.C. 154(b) by 0 days.

(21) Appl. No.: 11/294,607

(22) Filed: Dec. 6, 2005

(65) Prior Publication Data

US 2007/0131100 A1 Jun. 14, 2007

Related U.S. Application Data

(63) Continuation-in-part of application No. PCT/IL2004/000473, filed on Jun. 3, 2004.

(51) Int. Cl.
*G10H 1/00* (2006.01)

(52) U.S. Cl. ..... 84/626; 84/662

(58) Field of Classification Search ..... 84/725–728, 84/626, 662
See application file for complete search history.

(56) References Cited

U.S. PATENT DOCUMENTS

| | | | | |
|---|---|---|---|---|
| 2,310,606 | A * | 2/1943 | Barth | 84/726 |
| 4,481,854 | A | 11/1984 | Dugas | |
| 5,105,711 | A | 4/1992 | Barnard | |
| 5,245,128 | A | 9/1993 | Araiza | |
| 5,347,906 | A * | 9/1994 | Geiger | 84/453 |
| 5,700,966 | A * | 12/1997 | LaMarra | 84/645 |
| 5,864,083 | A | 1/1999 | Caren | |
| 6,570,078 | B2 * | 5/2003 | Ludwig | 84/600 |

* cited by examiner

*Primary Examiner*—David S. Warren
(74) *Attorney, Agent, or Firm*—Martin Fleit; Paul D. Bianco; Fleit Gibbons Gutman Bongini & Bianco PL

(57) ABSTRACT

The proposed invention is a portable multi-sound effect system providing a novel and unique solution for processing the electrical audio signals created by a guitar. The innovation according to the present invention is by attaching a signal processing unit along with a touch-sensitive dynamic control unit upon the front panel of the guitar's body for controlling and processing electrical signals produced by an amplified guitar, e.g. electric, bass, acoustic or classic guitar.

21 Claims, 12 Drawing Sheets

MULTI-SOUND EFFECT SYSTEM INCLUDING DYNAMIC CONTROLLER FOR AN AMPLIFIED GUITAR

This application is a continuation in part, claiming priority from PCT application no. PCT/IL04/00473 filed on Jun. 3, 2004 having a priority date of Jun. 6, 2003.

BACKGROUND

The present invention relates to the field of signal processing units that process and manipulate the electric audio signals created by an amplified guitar. More particularly, the invention relates to a signal processing unit containing a touch sensitive dynamic control unit which is mounted on a guitar for controlling, manipulating and processing in a convenient way up to three dimensions of sound effect parameters in real time while playing the guitar.

While the electric guitar allows varying musical sounds (e.g. tone, volume, switching between the pickups) only in the most basic way by using old-fashioned analog technology, electric guitar players are in dire need to produce an unlimited array of musical sounds. Hence, to improve the sound guitar players used to add various kinds of signal processor accessories also known as "effects", "stomp-boxes", "pedals" or "multi-effects" between the guitar and the guitar amp.

The long list of sound effects include overdrive, distortion, fuzz, compressor, limiter, expander, gate, graphic equalizer, chorus, flanger, phaser, wah-wha, pitch, phase shifter, rotating speaker, tremolo, vibrato, vibes, talker, delay effects, reverb effects and various kinds of simulation effects (which enable the simulation of different preamps, amps, guitars, cabinets, pickups and stomp-boxes). The contribution of these sound effects to the music industry is significant. The effects take place in most of the modern popular music and have great influence on the style of music. Furthermore, a guitar sound effect can even create music style. For example, the hard and heavy rock music styles cannot be played without adding distortion effect to the guitar sound.

The signal processor also enables guitar players to imitate sounds of different types of environment (rooms, halls, studios, parks, etc. . . . ) or mimic the sounds created by different types of amplifiers. By using multi-effects, the guitar player can simulate different types of cabinets, guitars and stomp boxes instead of buying them, thereby saving a considerable amount of money. The possibilities in this field are endless. By using effects the guitar player can create wider range of sounds that add dimension to the music, thus even a dry and uninspired sound can jump to life.

Owing a lot to sound processing improvement technology and electronic miniaturization, multi-effect units became a credible and effective tool for the modern guitarist. The modern electric guitar player is exposed to and influenced by the technological advances in the global music domain. Corresponding to this, not only have they become open-minded to the new technologies, but they are also seeking for and demanding new features, new effects and richer quality sounds.

For an electric guitar user to be able to extract the variety of sounds and flexibility of playing similar to musicians in other domains, he or she need to keep up to date with the changes the electric guitar can offer or accept. Therefore, numerous attempts for developing sound effect algorithms and sound processing control units as well as integration of computerized tools within the guitar itself have been made in recent years.

A Signal Processing Unit (SPU) is a sound effect or a multi-effect signal processor. The SPU receives two different types of signals in its inputs-audio signals and control signals. The audio signals are received from the guitar, the guitar pickups or an intermediate unit, while the control signals are received from a control unit. According to the desired program selected by the user, the audio signal is then processed and altered by a software algorithm or an electrical circuit. Such algorithms or circuits have changeable parameters that are changed according to the control signals received from the static and dynamic control units.

The SPU is statically controlled by a set of selectors, i.e. buttons and knobs which provide the guitar player with the ability to edit desired programs, to access and set various effect parameters prior to playing the guitar and to select the desired effects from the effect bank while playing.

It can be appreciated, however, that these devices for changing characteristics of the sound signal have several disadvantages or limitations.

In order to set the different effect parameters while playing the guitar, the musician has to remove his hands from the guitar strings to adjust the proper knob or a dial of the signal processing unit, which is usually located on the floor or in a rack mount. As a result, the musician cannot continue to play the instrument during that interval. This causes disruptions in the melody and limits the number of changeable parameters provided, thus restricting the guitar player from changing in real-time the various parameters regarding the processes sound signal. This problem is somewhat solved by using foot pedals.

Pedal Devices, such as foot pedals, are either integrated within a Signal Processing Unit (SPU) or function as an expansion thereof. Said devices enable a guitar player to dynamically control and change the parameters of the process algorithm, the electrical circuit and the sound created thereby. The guitar player controls such parameters by heeling or toeing the pedal, thereby changing a scalar of parameters.

However, the Pedal Devices are generally fixedly positioned in one place which requires that the musician also remain in the same place. In many musical performances, musicians prefer to move around the stage, and their ability to do so is hampered when they have to remain in the proximity of the foot pedals to effectuate changes in the characteristics of the audio signals that they are producing. Therefore, foot pedals restrict the guitar player's movement and distract his performance while controlling the music effects by limiting his movement to a single fixed position.

Furthermore, during live performance, the Pedal Device which is located on the stage floor cannot be seen by the audience. This limitation prevents the guitar player from combining a visual sound effect performance while playing the guitar (such as the "show" that guitar players give using the tremolo handle while performing).

In addition, Pedal Devices restrict the guitar player from independently controlling more then one effect parameter at a time. This limitation poses a major restriction on the number of effects simultaneously controlled and the range of sounds created thereby.

Furthermore, Pedal Devices impose complex hand-foot coordination and thus are limited by the lack of sensitivity and speed.

Additionally, Pedal Devices can be activated only by legs. This poses a great limitation for guitar players who suffer from medical problems in which prevent them from using their legs for activating and controlling the signal processing unit during their playing.

Numerous attempts to provide a signal processing unit which controls and manipulates effects of an electric guitar have been made in recent years. U.S. Pat. No. 6,570,078 proposes a system for generating control signals. Said system comprises a pixel data array for extracting pattern and direction information by applying image processing including the use of touch-pads, potentially fitted with impact and/or pressure sensors. Although the configuration of a touch pad is mentioned as a control unit, the prior art lacks the ability to provide a portable and removable signal processing unit in an amplified guitar and does not enable the guitar player to control the multi sound effects while simultaneously playing the guitar.

U.S. Pat. Nos. 5,105,711 and 5,245,128 propose a removable mountable effects device for an electronic signal processor in an electric guitar. Said device includes a selection panel for accessing and selecting multiple effects from the signal processor contained therein, which may be a keyboard mounted on the guitar face providing easy accessibility to the fingers of the guitar player. However, these inventions are restricted to static controllers only and do not allow the controlling, manipulating and processing of up to three dimensions of sound-effect parameters in real time while playing the guitar.

U.S. Pat. No. 5,864,083 proposes a force sensing device which is mounted upon the guitar pick and connected to a musical effect generator that receives the electrical music signal from the guitar and alters the musical signal to produce a musical effect.

U.S. Pat. No. 4,481,854 discloses an electrical stringed and fretted musical instrument which has at least two pick-ups, bass boost filter means and high boost filter means. A single joy stick control, which is located upon the body of the guitar, varies all of these magnitudes simultaneously. However, this technique is limited to control only the tones of the guitar and not all effect parameters.

None of the existing methodologies propose an improved removable and portable sound effect signal processing system for controlling, manipulating and processing in a convenient way of up to three dimensions of sound-effect parameters while playing the guitar, as desired by guitar players.

It is thus an object of the invention to provide a novel solution for dynamically controlling and activating the sound effect parameters in a convenient way while playing the guitar without restricting the guitar player's movements.

It is another object of the present invention to present a solution that will overcome all the disadvantages arisen regarding the use of pedal devices in accordance with their location and limited number of changeable effect parameters.

It is yet another object of the invention to provide the guitar player with the ability to remove the system from one guitar and attach it to another guitar.

SUMMARY

The present invention provides a multi-sound effect system including a touch-sensitive dynamic control unit (DCU) and a signal processing unit (SPU). The SPU is provided for processing the audio electrical signals received from an amplified guitar, wherein the DCU enables a guitar player to change the multi-sound effects simultaneously while playing the guitar by moving his picking hand across the touch-sensitive surface of said DCU.

The SPU is further applied to start and stop the activation of the signal processing unit by touching said dynamic control unit. Said unit can be implemented by DSP.

The DCU is located beneath the guitar strings at the lower front panel of the guitar's body excluding a bass guitar. In case of a bass guitar, said unit can be located either beneath or above the guitar strings at the upper front panel of the guitar's body.

The DCU is able to measure up to three dimensions for achieving a dynamic control over the sound-effect parameters simultaneously, wherein each dimension controls at least one sound-effect parameter. The different dimensions may represent one of the following: the absolute position, the relative position, the amount of absolute pressure or the amount of relative pressure in a given time with respect to the horizontal and vertical directional position of the finger across the touch-sensitive surface of the control unit. This unit is further applied to measure the location of more than one operating finger at a time.

The present invention proposes a plurality of preferred embodiments regarding the implementation of the DCU. These embodiments according to the present invention include a trackball, a sliding potentiometer, a roller potentiometer, push buttons, a touch-pad, a touch-screen, a dynamic ribbon, a joystick and optical or infrared sensors reacting to the position of the finger on the DCU's surface.

The proposed system further comprises a Static Control Unit, which is provided to select the pre-determined sound-effect parameters of the SPU as well as to set the system's mode of operation and to program files regarding the desired effects of the guitar. This unit includes a set of buttons and knobs for controlling the multi-sound effect parameters.

The proposed system further comprises a Management Unit which includes a processing unit, wherein this unit is provided to handle the system and its functionality.

The proposed system further comprises a Memory Unit which is provided to save and share program files, data files and recorded audio data regarding the operation of the system.

The proposed system further comprises a Signal Conversion Unit, wherein said unit includes an Analog to Digital and Digital to Analog Converters for converting the analog audio signals received from the guitar to their digital format and the digital audio signals back to their analog format respectively.

The proposed system further comprises an Amplification Unit for adjusting the level of the audio signals.

The proposed system further comprises an Interface Unit, which is provided to enable a physical connection between external audio signal sources and the inner system. The physical connection is applied for receiving and transmitting said audio signals.

The proposed system further comprises a Monitor Unit and a Visual Display LED (Light Emitting Diode) Unit, which are provided to give the guitar player relevant information regarding the system's status and its mode of operation.

The proposed system further comprises a Communication Unit for receiving efficient communication between the proposed system and external systems and for enabling a sharing procedure of data files, program files and audio files.

The proposed system further comprises a Musical Instrument Digital Interface (MIDI) Control Unit for controlling and communicating with different instruments and effects supported by MIDI protocols.

The proposed system further comprises a Keyboard interface for entering data, accessing, selecting and programming the multi-sound effects through external programming devices.

The entire system's components excluding the DCU may be either located as a stand-alone unit, mounted upon the body of the guitar or built-in to the body of the guitar. The connection between said components and the DCU is either a wireless or a wired connection.

The proposed system according to the present invention further includes a mechanism for attaching the DCU to the front panel of the amplified guitar under the guitar's strings. The mechanism is a strap attachment, which either passes under the guitar's strings or threaded side to side from the front panel of the guitar and pass under the guitar's strings in between the guitar's pickups, thus encompassing the body of the guitar and tightening the DCU to the front panel of the guitar. The strap attachment may be in the form of a clipping device, a velcro strap, glue, vacuum buttons or bolts.

The proposed system further comprises additional units, such as a metronome, a drum machine, an MP3 encoder, an MP3 decoder, a guitar or bass tuner, a sequencer, dictionary accords and electrical tablature (TAB) book.

Hence, the present invention discloses a solution that overcomes all the disadvantages arisen regarding the use of pedal devices with accordance to their location and the limited number of changeable effect parameters. The invention has the following major benefits over traditional multi-effect systems existing in today's market. It enables the guitar player to dynamically control and manipulate up to three dimensions of multi-sound effect parameters. As a result, the musician can produce a wider range of sounds, add new color to his music and even create new music styles. Furthermore, the invention provides the guitar player with the ability to play the effect more naturally and with greater emotion by using the "touch-response" mechanism. The guitar player has the ability to maneuver and manipulate the effect in enhanced speed of actuation by using his hand instead of his leg to activate the dynamic controller, thus leading to better performance.

The invention provides the guitar player with the ability to remove the system from one guitar and attach it to another guitar. Attaching the system to the guitar makes it portable. As a result, the guitar player can freely move anywhere while simultaneously playing the guitar and operating the effect unit. Furthermore, the invention allows the guitar player to improve his live performance, by showing the audience the way he alters the sounds using his hand.

BRIEF DESCRIPTION OF THE DRAWINGS

These and further features and advantages of the invention will become more clearly understood in light of the ensuing descriptions of the preferred embodiments thereof, given by way of example only, with reference to the accompanying drawings, wherein.

DESCRIPTION OF THE PREFFERED EMBODIMENT

Figure 1:
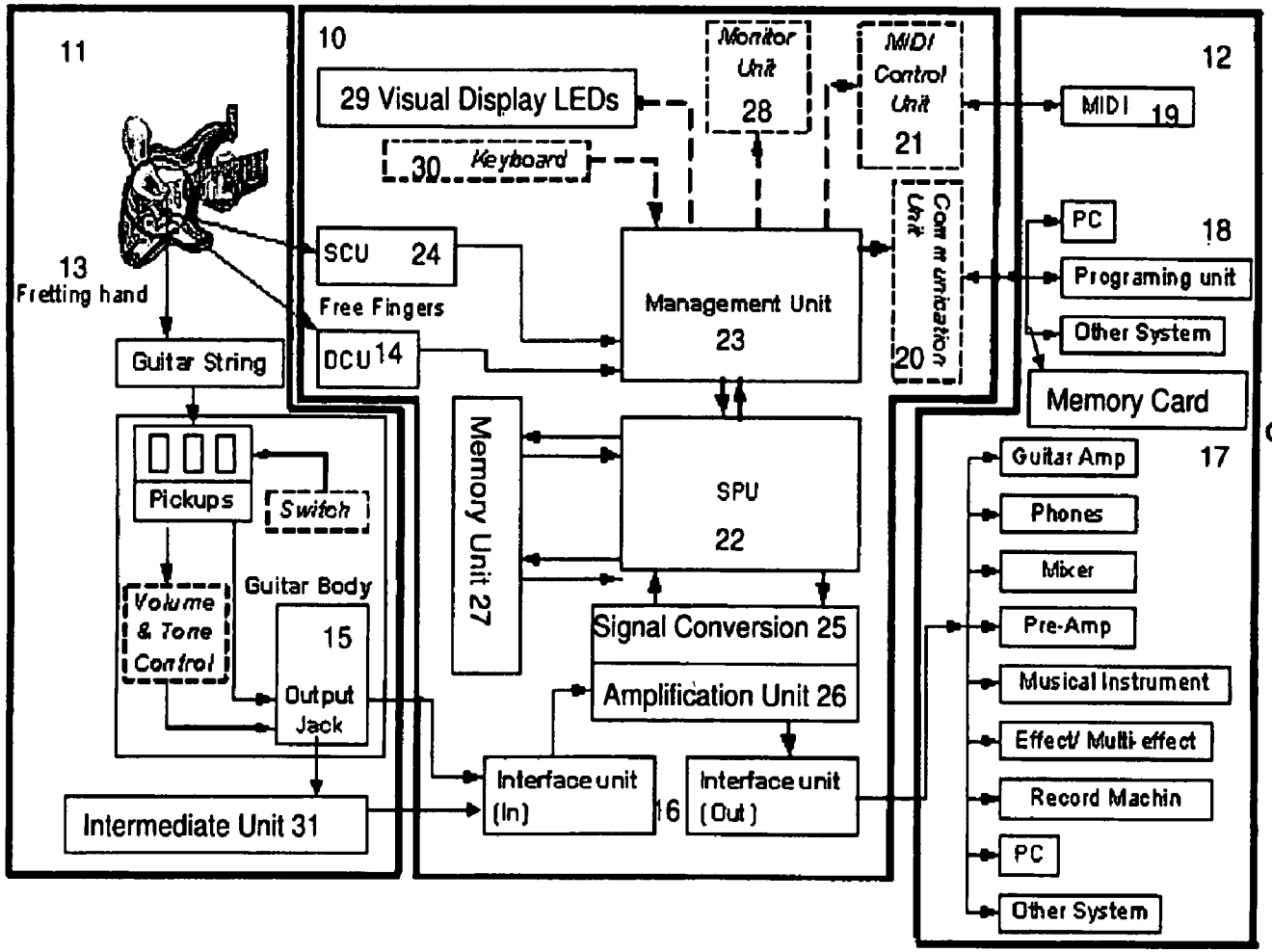
FIG. 1 is an overview illustration describing the different components comprising the multi-sound effect system according to the present invention.

The proposed invention is a portable and removable multi-sound effect system providing a novel and unique solution relating to a signal processing unit for processing the electrical audio signals created by a guitar.

The innovation according to the present invention is attaching a signal processing unit along with a touch-sensitive dynamic control unit upon the front panel of the guitar's body for controlling and processing electrical signals produced by an amplified guitar, e.g. electric, bass, acoustic or classical guitar. This arrangement enables the guitar player to dynamically control and manipulate in a convenient way the multi-sound effect parameters. The unit provides the guitar player with control over up to three dimensions of these parameters while simultaneously playing the guitar.

The proposed system is composed of a Signal Processing Unit (SPU), such as a Digital Signal Processor (DSP) and a Dynamic Control Unit (DCU). The DCU is a touch-sensitive dynamic control unit implemented as a sliding potentiometer, a roller potentiometer, push buttons, a tracking-ball, a touch-pad, a touch-screen, a dynamic ribbon, a joystick, a mouse, optical sensor array, infrared sensors or as a combination thereof. The SPU receives audio signals from the guitar pick-ups and control signals from the DCU, whereas said control signals indicate the location and pressure of the guitar player's finger over the DCU.

The guitar player usually plucks the guitar strings using his thumb or a pick he grasps between his thumb and his index finger. Those picking techniques leave the other fingers of his picking hand the ability to freely move while simultaneously picking or strumming the guitar strings.

The DCU is mounted upon the front panel of the guitar in a way that the guitar player can maneuver at least one of his free fingers (middle, ring or pinky) of his picking hand over the DCU surface in a convenient way while picking or strumming the guitar's strings. In all amplified guitars (i.e. electric, bass, acoustic or classic guitar) the DCU is attached beneath the guitar strings at the lower front area of the guitar body, whereas in a bass guitar the DCU may be further attached above the guitar strings at the upper front area of the guitar body. In the case of a bass guitar, wherein the DCU is located above the strings, the bass player can use his thumb to maneuver upon the DCU and the rest of his fingers to strike the strings.

The DCU includes a sensor which measures up to three dimensions for controlling the multi-sound effect parameters simultaneously in real time, whereas in each dimension a plurality of parameters regarding said sound-effects can be changed. The plurality of parameters include common distortion parameters (such as gain, output level, tone, EQ or filter), common compressor parameters (such as Input level, threshold, gain reduction ratio, knee, attack time, release time, output level), common gate parameters (such as threshold, attack time, gain reduction ratio, range, hold or release time, decay time, output level), common modulation effect parameters (such as rate, feedback or regeneration, time delay, depth, mix), common filter effects or wah-wah parameters (such as low-pass, band-pass and high-pass filter frequency) common delay parameters (such as delay time, feedback, mix) and common reverb parameters (such as pre or initial delay, diffusion, crossover point, high and low frequency ratio, high and low frequency damping, density, balance, or early reflection delay).

The dimensions mentioned above may either represent the absolute position, the relative position, the amount of absolute pressure or the amount of relative pressure in a given time with respect to the horizontal and vertical directional position of the finger across the touch-sensitive surface. Furthermore, said sensor is able to measure the absolute or relative position and pressure of more than one operating finger at a time.

The one dimensional X sensor measures the absolute position in a given time of the finger that is operating the unidimensional X sensor, whereas X represents the absolute position of the finger over the DCU sensor.

The one dimensional ΔX sensor measures the relative position in a given time of the finger that is operating the unidimensional ΔX sensor, whereas ΔX represents the relative position of the finger with respect to a given reference point over the DCU sensor.

The two dimensional X-Z sensor measures the absolute position and pressure of the finger that is operating the X-Z sensor in a given time, whereas X represents the absolute position of the finger over the DCU sensor and Z represents the amount of absolute finger pressure over the DCU sensor.

The two dimensional ΔX-ΔZ sensor measures the relative position and pressure of the finger that is operating the ΔX-ΔZ sensor in a given time, whereas ΔX represents the relative position of the finger with respect to a given reference point over the DCU sensor and ΔZ represents the amount of relative finger pressure with respect to a reference value over the DCU sensor.

The two dimensional X-Y sensor measures the absolute position of the finger that is operating the X-Y sensor in a given time, whereas X represents the absolute position of the finger in horizontal direction and Y represents the absolute position of the finger in vertical direction.

The two dimensional ΔX-ΔY sensor measures the relative position of the finger that is operating the ΔX-ΔY sensor in a given time, whereas ΔX represents the relative position of the finger with respect to a given reference point in the horizontal direction and ΔY represents the relative position of the finger with respect to a given reference point in the vertical direction.

The three dimensional X-Y-Z sensor measures the absolute position of the finger that is operating the X-Y-Z sensor in a given time, whereas X represents the absolute position of the finger in horizontal direction, Y represents the absolute position of the finger in vertical direction and Z represents the amount of pressure produced by the operating finger.

The three dimensional ΔX-ΔY-ΔZ sensor measures the relative position of the finger that is operating the ΔX-ΔY-ΔZ sensor in a given time, whereas ΔX represents the relative position of the finger with respect to a given reference point in horizontal direction, ΔY represents the relative position of the finger with respect to a given reference point in vertical direction and ΔZ represent the amount of relative finger pressure with respect to a reference value over the DCU sensor.

Once the DCU senses the finger contact and measures the dimensions required for controlling the different sound-effect parameters as described above, control signals containing this information are transmitted to the SPU. The SPU sound-effect program is selected in advance by the user (through the SCU). Thus, according to the desired program and the control signals received from the DCU, the SPU then processes and alters the guitar audio signals via a software algorithm.

More particularly, the SPU is able to start, stop and process the sound created by the guitar with respect to contact and/or pressure and/or location and/or the amount of time that the finger is activating the DCU. This allows the guitar player to continuously or discontinuously change the guitar sound by continuously or discontinuously maneuvering his finger over the DCU.

The present invention leads to the following major benefits over traditional multi-effect systems existing in today's market. Firstly, the system allows the guitar player to change in real-time up to three effect parameters at once, said effect parameters being in the three physical axes −X, Y, Z+W, whereas W represents the system response to the touching of more than one finger on the DCU. As a result, the musician can produce a wider range of entirely new sounds, add new dimension and color to his music and even create new music styles. For example, by using a 3D X-Y-Z touchpad DCU the guitar player is able to achieve the following results—increase the distortion gain effect parameters by vertically moving his finger over the touchpad across the X axis, combine a wah-wah effect by horizontally moving his finger in a cyclic movement across the Y axis, and to increase/decrease the overall volume by pressing his finger on the touchpad surface or releasing the finger thereof. Furthermore, this feature provides the guitar player with the ability to balance between at least two effect parameters while simultaneously playing the guitar (e.g. he can increase the level of distortion gain parameter and at the same time decrease the reverb time delay parameter). This novel feature is very useful particularly during a live performance.

Secondly, by using a "touch-response mechanism", which is sensitive to the amount of the pressure and vibration that the finger is activating over the DCU, the guitar player can control the multi-sound effects more naturally and with greater emotion. In a 3D X-Y-Z touch pad, for example, the guitar player may increase the volume and the sound sustain by applying pressure on the touchpad. In this case he can place his pinky finger on a desired location over the touchpad and while plunking the strings he can add spice to the music by pressing, releasing or vibrating his pinky.

In addition, since the hand is quicker than the leg, the DCU activated by hand provides the guitar player with the abilities to maneuver and manipulate the effects in enhanced speed of actuation. Said abilities lead to a quicker response time in which the SPU algorithms are controlled and thus lead to a better performance in the sound created thereby.

Moreover, since both the DCU and the guitar strings are activated by the same hand, the invention bypasses the complex hand-foot coordination required by a guitar player that is using Pedal Device. As a result, it dramatically shortens the player's learning curve and saves him a lot of hours of training for reaching the same level of performance.

This feature leads to another advantage, while both the guitar and the effects are activated by the guitar player's hand, the invention provides guitar players who are suffering from medical problems which prevent them from activating effects with their legs, with the opportunity to use dynamic sound-effect in their playing.

The present invention introduces a portable system, attaching the system upon the guitar enables the guitar player to move freely anywhere while simultaneously playing the guitar and dynamically operate the multi-effect control unit by maneuvering in real-time the hand over its surface. This novel feature is very useful particularly on stage during live performance.

The invention provides the guitar player with the ability to remove the system from a guitar, carry it anywhere he like, and attach it to another guitar.

Furthermore, attaching the DCU upon the front panel of the guitar allows the guitar player to present a visual sound manipulation performance by showing the audience the way he alters the sounds by maneuvering his hand over the DCU (similar to the "show" guitar players give in concert by altering the guitar sound using the tremolo handle, playing their guitars with electric drillers, playing a guitar behind their heads, plunked the strings with their teeth, take a solo while doing a back-flip on trampoline and many others good "Show" techniques). As a result, the guitar player can upgrade his performance and increase the audience pleasure.

In general, the invention gives the guitar player the opportunity to raise his musical and playing performance. It allows the guitar player to add new dimension and creativity to both guitar playing and music composing which will dramatically increase the pleasure and enjoyment of playing the guitar.

The DCU according to the present invention can be further implemented as a detachable unit, a built-in unit in the body of the guitar. In addition, the system's components excluding the DCU may be either located as a stand-alone unit, either mounted upon the body of the guitar or implemented as a built-in unit in the body of the guitar.

FIG. 1 is an overview illustration describing the different components comprising the multi-sound effect system according to the present invention. The Input Device [11] is provided for transmitting audio signals to the proposed multi-sound effects system [10], whereas the Output Devices [12] are provided for receiving audio signals, for receiving and transmitting control signals and for sharing data, audio and program files containing information regarding the operation and programming of the multi-sound effects system.

The Input Device [11] is comprised of an electric guitar [13], whereas the DCU [14] is attached to the lower area of the front panel. Attaching the DCU to this area of the guitar allows the guitar player to maneuver at least one of his picking hand fingers over the DCU in a convenient way while playing the guitar. Most electric guitars are completely passive, i.e. consume no power, therefore one doesn't have to plug them into a power supply. The audio signals leave the guitar through the output jack [15], which is located on the guitar body [9], and transmitted into the system through the Interface Unit [16]. Said signal transmission is applied either by a wire cable or other wireless mechanism allowing the transmitting of the audio signals from the guitar into the system. In some cases an Intermediate Unit [31], comprising of other instrument devices, may be applied between the guitar and the proposed system. The intermediate unit/s can be, for example, other processing unit/s (e.g. floor-sound effects, multi-effect processors, rack-mounted processors, stomp boxes, effect pedals, equalizers, desktop effects and portable effects), a pre-amplifier, controller pedals, volume pedals, mixer, single/multi-track recorder machine, computer, other musical instruments, microphone or any combination thereof.

The Output Devices [12] are composed of three different types of devices. The audio signals are transmitted to these devices via a cord cable or wireless mechanism.

The first type of device [17] is comprised of an electrical instrument that reacts to the transmission of audio signals received from the proposed system. These devices may include a guitar amp, head-phone, other multi-sound effects system, other kinds of audio signals processors (e.g. floor sound effect, multi-effect processors, rack-mounted processors, stomp boxes, effect pedals, equalizer, desktop guitar effect, portable effect), musical instrument, mixer, record machine or combination thereof.

The second type of device [18] is comprised of an electrical instrument used for communicating with the proposed system in order to receive the control signals, transmit the signals, or share data, audio and program files regarding the multi-sound effects. These devices may include a PC, a memory card, an external programming unit and other equivalent multi-sound effect systems.

The third type of device [19] is comprised of an electrical musical instrument used for communicating with different musical instruments, which are supported by a Musical Instrument Digital Interface (MIDI) protocol. Said protocol controls and communicates with different musical instruments and sound-effects, providing they support the MIDI protocol.

The Communication Unit [20] connects between the proposed system and Output Devices of the second type [18], thus, providing an efficient communication.

The MIDI Control Unit [21] is provided to connect to the Output Devices of the third type [19] via a cord cable or wireless mechanism. The connection between these devices is to enable control and communicate with different musical instruments and effects that are supported with MIDI protocols.

The Dynamic Control Unit (DCU) [14] is implemented as a touch-sensitive sensor for controlling the SPU algorithm, which process the audio signals produced by the guitar. Said DCU is provided for identifying and delivering information concerning the location or pressure of the finger activating the unit. The main advantage of this unit is that it enables the guitar player to dynamically change the various sound-effects and parameters while playing the guitar. The DCU transmits control signals either to the Management Unit [23] or directly to the SPU [22].

The Signal Processing Unit (SPU) [22] is a sound effect or multi-effect audio signal processor. This unit is designated to dynamically process and alter incoming audio signals transmitted from the guitar with respect to the control signals received from the DCU [14], Static Control Unit (SCU) [24] or from the Management Unit [23].

The Static Control Unit (SCU) [24] is comprised of a set of buttons and knobs usually used for accessing, editing, programming and pre-setting sound-effect parameters. While playing the guitar, the SCU enables the guitar player to select and fetch effect programs from the effects bank. The SCU transmits control signals concerning said parameters to the Management Unit [23] or directly to the SPU.

The Management Unit [23] is provided to handle and control the system's operation and functionality. It further manages and controls the system's peripheral devices. The Management unit receives control signals from the SCU and the DCU according to the pre-selected settings and the location of the guitar player's finger over the DCU. Said unit includes a processor unit which may be in the form of a micro-processor, a Digital Signal Processing unit (DSP), a designated signal processor (e.g. FPGA, ASIC) or a processing device (e.g. ARM, RISK, Pentium, etc. . . . ). The processor unit translates the control signals into a signal format required by the SPU and processes them according to a set of commands and instructions. In addition, the Management Unit handles memory devices, display drivers, communication protocol between inner units and external devices and manages the different aspects regarding the propose system, such as initialization processes, alarms, boot, timing, programming procedures, effect editing, audio pattern recordings, etc.

The Interface Unit [16] is provided to enable a physical connection between external sources, e.g. input and output devices, and the proposed system for receiving and transmitting audio signals. The Interface Unit at the input stage transmits the analog audio signals received from the Input Device [11] to the Signal Conversion [25] and Amplification [26] Units. Whereas, at the output stage said audio signals are further transmitted to the Output Devices [17]

The Signal Conversion Unit [25] includes an Analog to Digital Converter (ADC) unit and a Digital to Analog Converter (DAC). The ADC is provided to convert the analog signals received from the guitar to a digital signals format which required by the SPU. The Digital to Analog Converter (DAC) unit is provided to convert the digital signals to an analog format required by the Output Devices [17].

The Amplification Unit [26] is provided for adjusting the signal's level according to the system's and peripheral devices' requirements.

The Memory Unit [27] is provided for saving and sharing the programs, data and audio files required for the proper operation of the proposed system. Said unit includes memory devices which may be in the form of ROM, RAM (such as SDRAM, SRAM.), Nonvolatile memory (such as FLASH, EPROM) or memory cards (such as smart-media, compact flash). The Memory Unit enables to read and write data to and from the SPU [22] and the Management Unit [23].

The Monitor Unit [28] and the Visual Display LEDs [29] are provided to give the guitar player relevant information of the various aspects regarding the proposed system. The various aspects may include the operation status, alarms, operation mode (such as programming or playing modes), multi-effect banks, sound-effect parameters, etc. The Monitor Unit [28] is a complementary unit including a display device, such as an alpha-numeric display, a graphical display, a Seven-Segment display, a touch-screen display, LCD display, TFT display etc.

The Visual Display LEDs unit [29] is a complementary unit comprising light bulbs, such as Light Emitting Diodes and lightened push buttons.

The Keyboard [30] is a complementary unit provided for additional data entering, accessing, selecting and programming multiple sound effects. Said communication is applied via an external keyboard or programming device.

The present invention further comprises a power supply functioning as a source for supplying the voltage and current required by the different units of the system. The power supply is provided to enable said units a proper functionality comes in a form of a battery (regular or rechargeable) or a transformer and can be either integrated within the system or located as an external unit. For example the power source may be a battery house located on the guitar strap or on the guitar player belt.

The proposed multi-sound effect system according to the present invention may further include additional units, such as metronome, drum machine, MP3 encoder, MP3 decoder, guitar or bass tuner, sequencer, accords dictionary and electrical tablature book.

Figure 2:
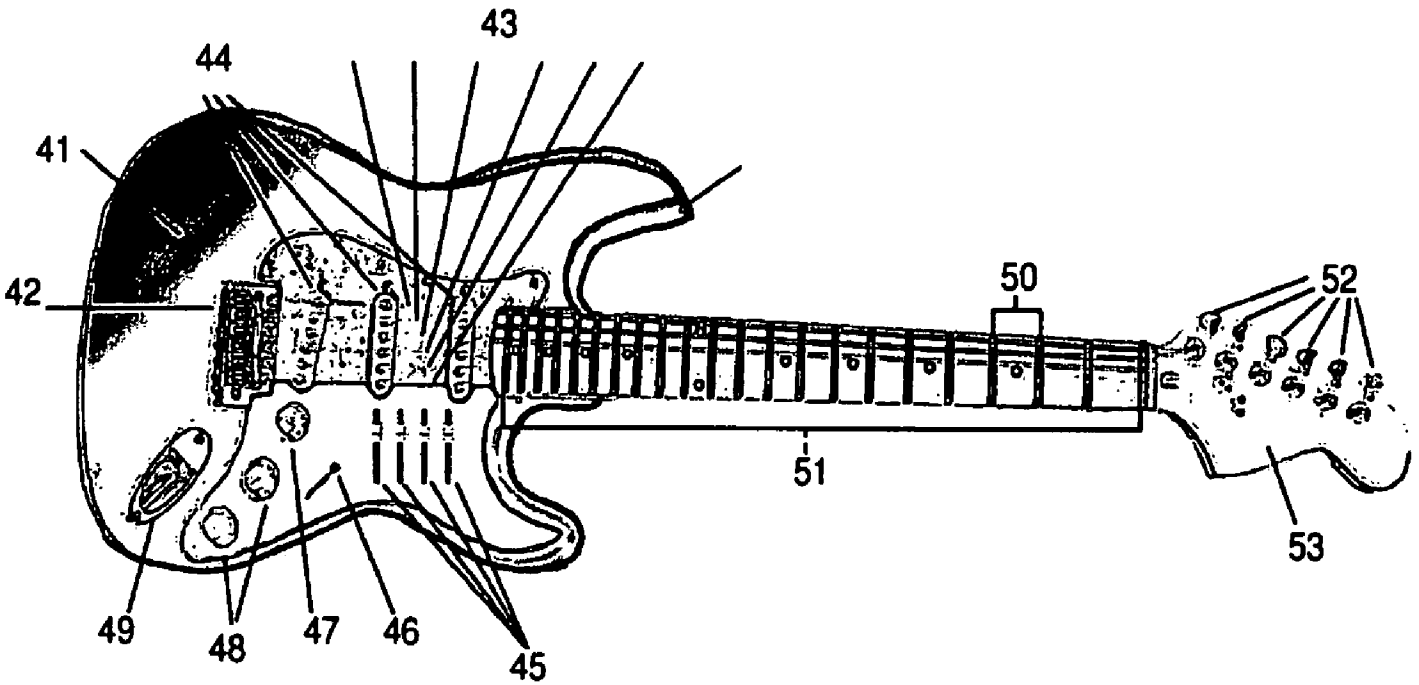
FIG. 2 is an illustration of a first embodiment according to the present invention and describes an electric guitar, including a sliding potentiometer DCU.

FIG. 2 is an illustration of a first embodiment according to the present invention and describes an electric guitar, including a sliding potentiometer DCU. The body of the electric guitar is generally denoted by the number [41]. The bridge of the guitar is denoted the number [42], the string area is denoted by the number [43] and the pickups provided for amplifying the sound of the strings are numbered [44]. The sliding potentiometer array device [45] providing multiple effects is mounted upon the lower front panel of the body of the guitar. The pickup selector switch [46] presented in this figure is located in nearby the volume knob [47] and tone knobs [48]. Further included upon the body of the guitar is an output jack [49] through which the audio signals are transmitted from. The guitar's neck [51] includes numerous frets [50] on it. The head stock [53] located at the far end of the guitar includes a tuning keys [52] mechanism, said mechanism provided for tuning the guitar's strings. According to the proposed embodiment, the guitar player is able to dynamically control and manipulate the multi-sound effect parameters by sliding at least one of his picking hand fingers over at least one sliding potentiometer while playing the guitar.

Figure 3:
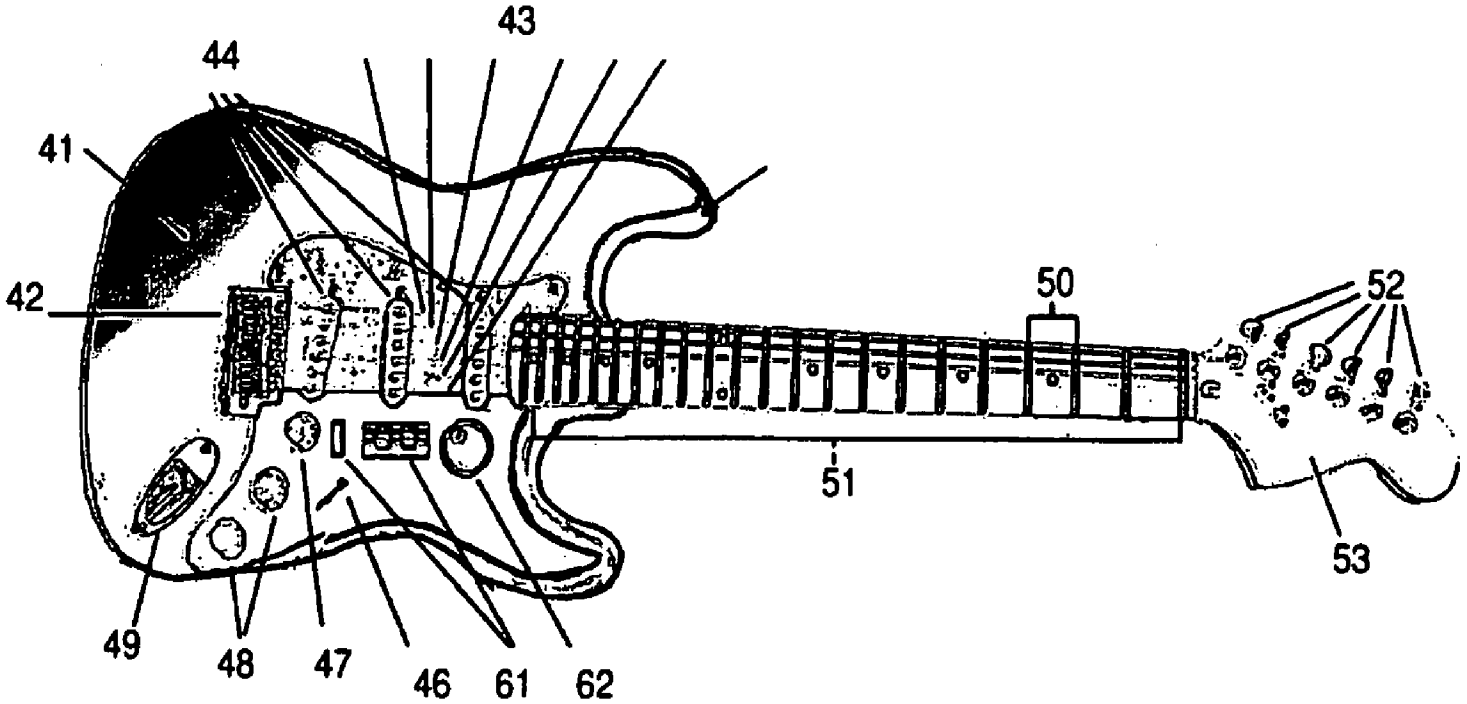
FIG. 3 is an illustration of a second embodiment of an electric guitar according to the present invention, including a roller potentiometer DCU.

FIG. 3 is an illustration of a second embodiment of an electric guitar according to the present invention, including a roller potentiometer DCU. According to this implementation, the roller wheels [61] or a dial [62] is mounted upon the lower front panel of the guitar body and enables the guitar player to dynamically control and manipulate the multi-sound effect parameters by moving at least one of his picking hand fingers over the roller wheels or the dial while playing the guitar.

Figure 4:
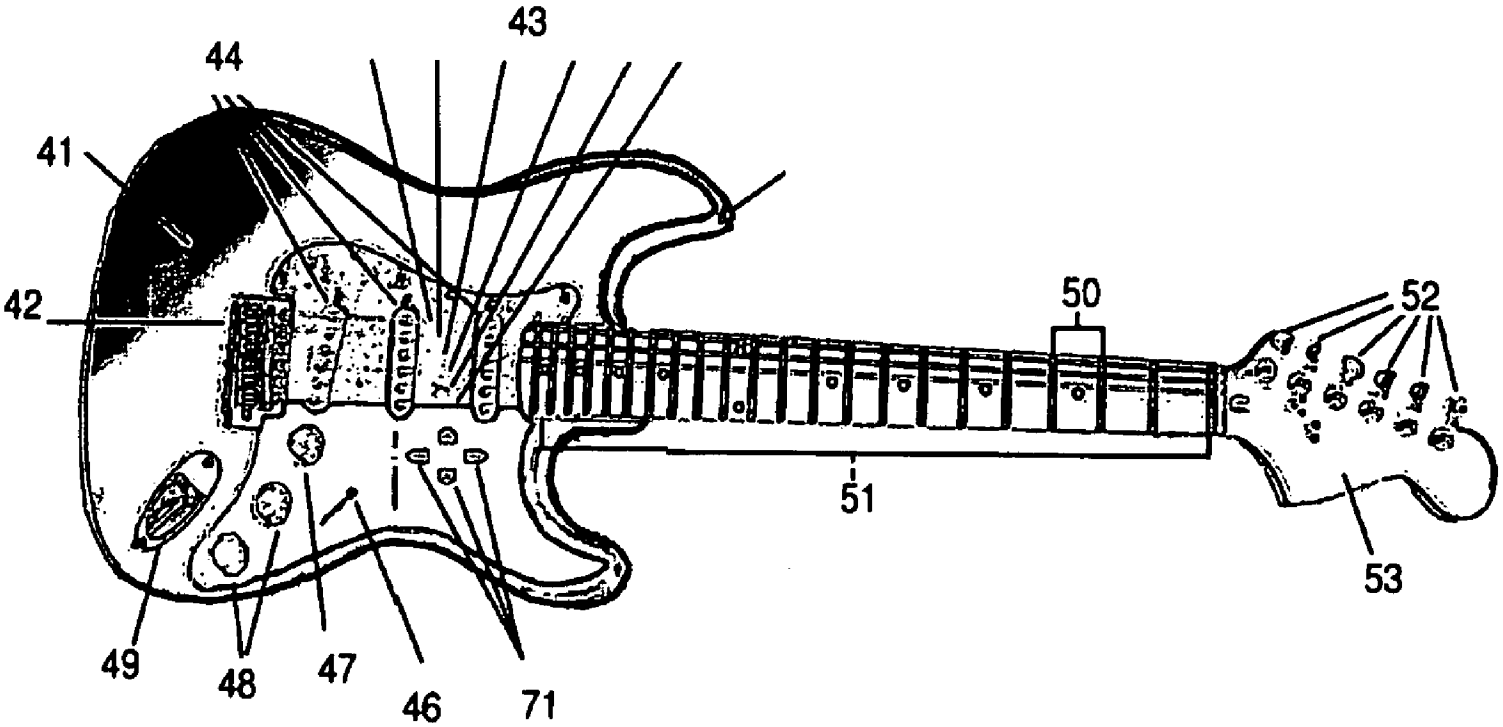
FIG. 4 is an illustration of a third embodiment of an electric guitar according to the present invention, including a push button array DCU.

FIG. 4 is an illustration of a third embodiment of an electric guitar according to the present invention, including a push button array DCU. According to this implementation, the push buttons [71] are mounted upon the lower front panel of the guitar body. This implementation enables the guitar player to dynamically control and manipulate the multi-sound effect parameters by pressing and holding at least one of his picking hand fingers on to the push buttons while playing the guitar.

Figure 5:
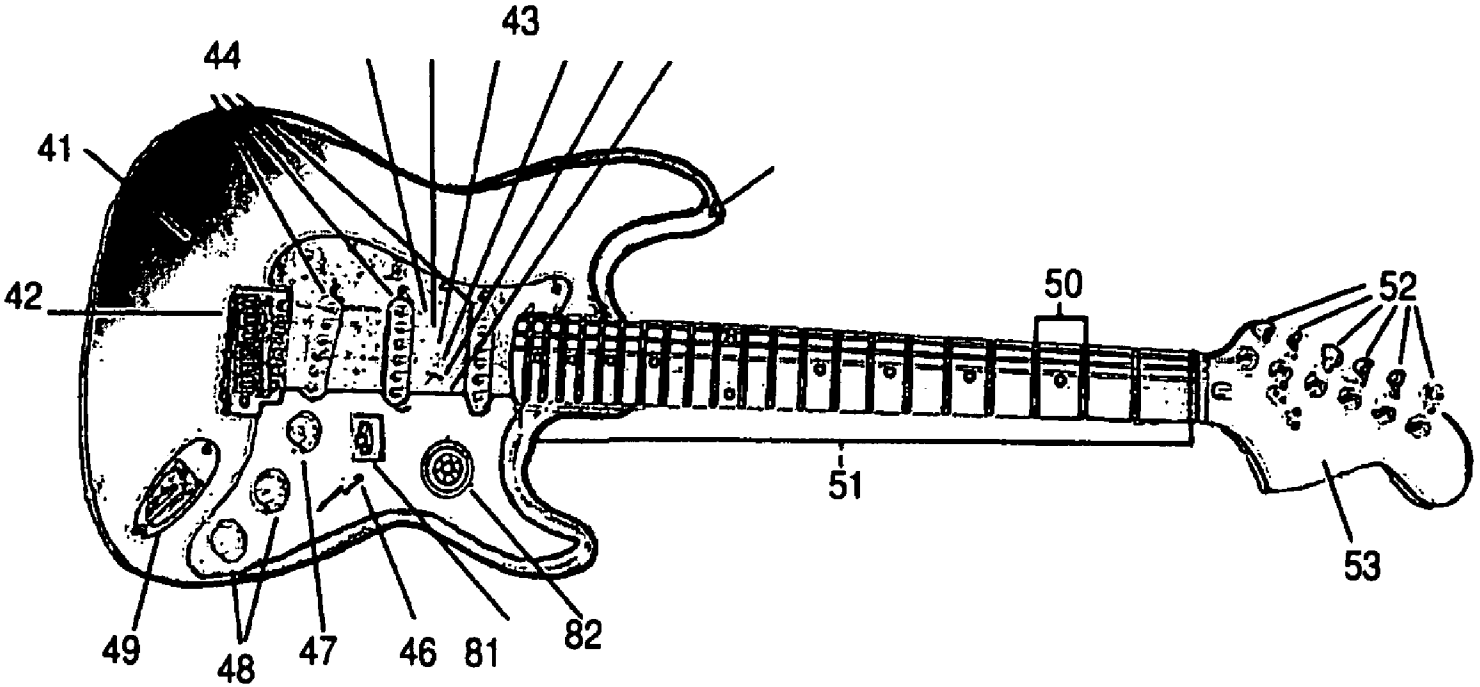
FIG. 5 is an illustration of a fourth embodiment of an electric guitar according to the present invention, including a joystick DCU.

FIG. 5 is an illustration of a fourth embodiment of an electric guitar according to the present invention, including a joystick DCU. According to this implementation, a push/pull stick [81] is included in a close proximity to the joystick [82] and is mounted upon the lower front panel of the guitar body. Said push/pull stick or joystick enables the guitar player to dynamically control and manipulate the multi-sound effect parameters by moving at least one of his picking hand fingers over the stick while playing the guitar.

Figure 6:
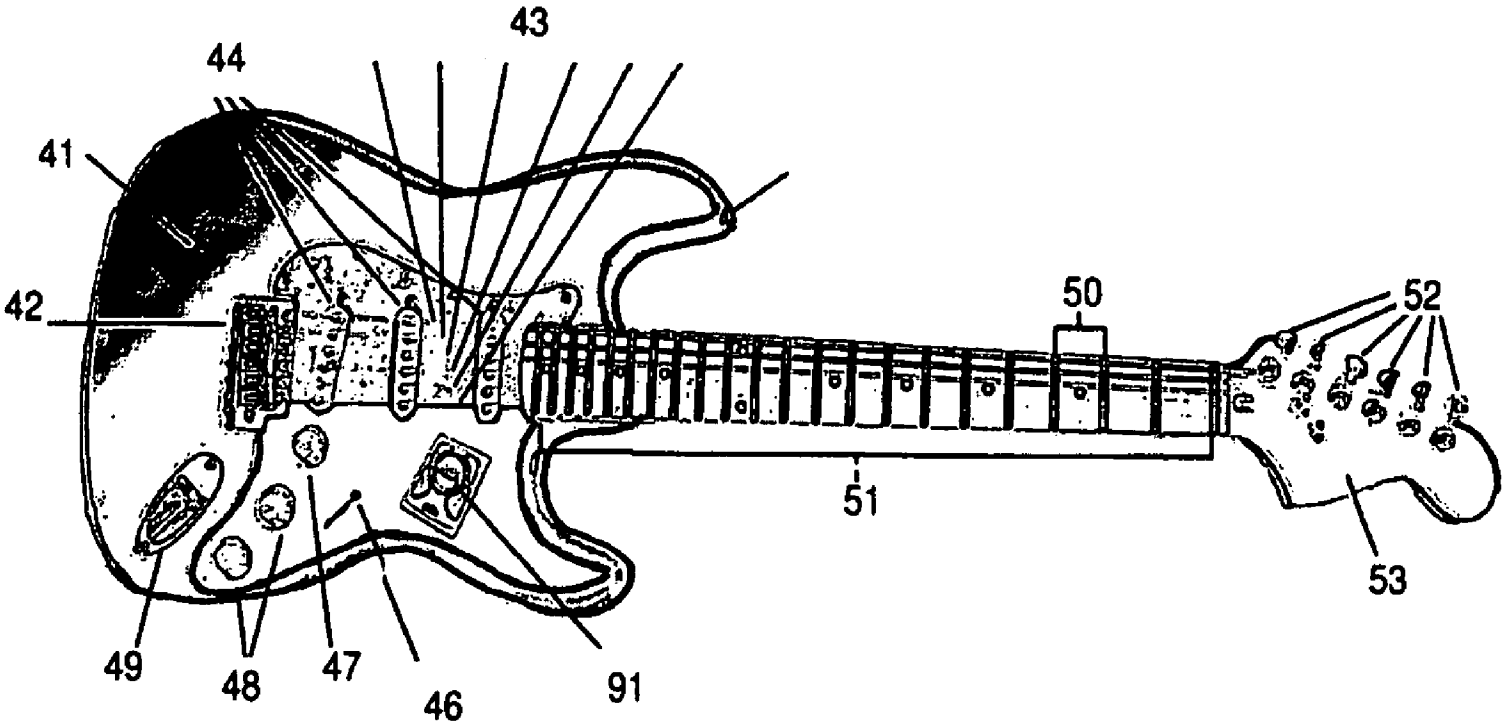
FIG. 6 is an illustration of a fifth embodiment of an electric guitar according to the present invention, including a tracking-ball DCU.

FIG. 6 is an illustration of a fifth embodiment of an electric guitar according to the present invention, including a tracking-ball DCU. According to this implementation, the tracking ball [91] is mounted upon the lower front panel of the guitar body and enables the guitar player to dynamically control and manipulate the multi-sound effect parameters by moving at least one of his picking hand fingers over the tracking ball while playing the guitar.

Figure 7:
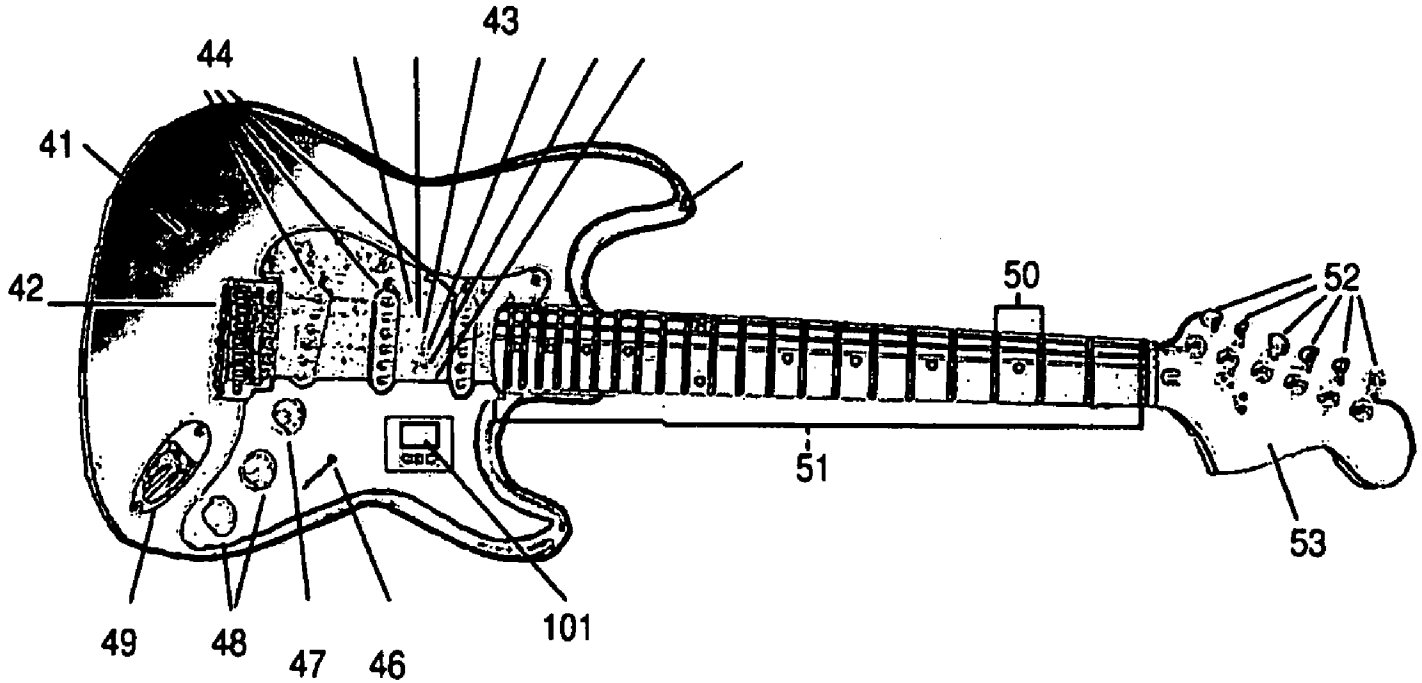
FIG. 7 is an illustration of a sixth embodiment of an electric guitar according to the present invention, including a touch-pad DCU.

FIG. 7 is an illustration of a sixth embodiment of an electric guitar according to the present invention, including a touch-pad DCU. According to this implementation, the touch pad [101] is mounted upon the lower front panel of the guitar body and enables the guitar player a dynamic control and manipulation of the multi-sound effect parameters such as distortion gain by moving at least one of his picking hand fingers over the touch-pad while playing the guitar.

Figure 8:
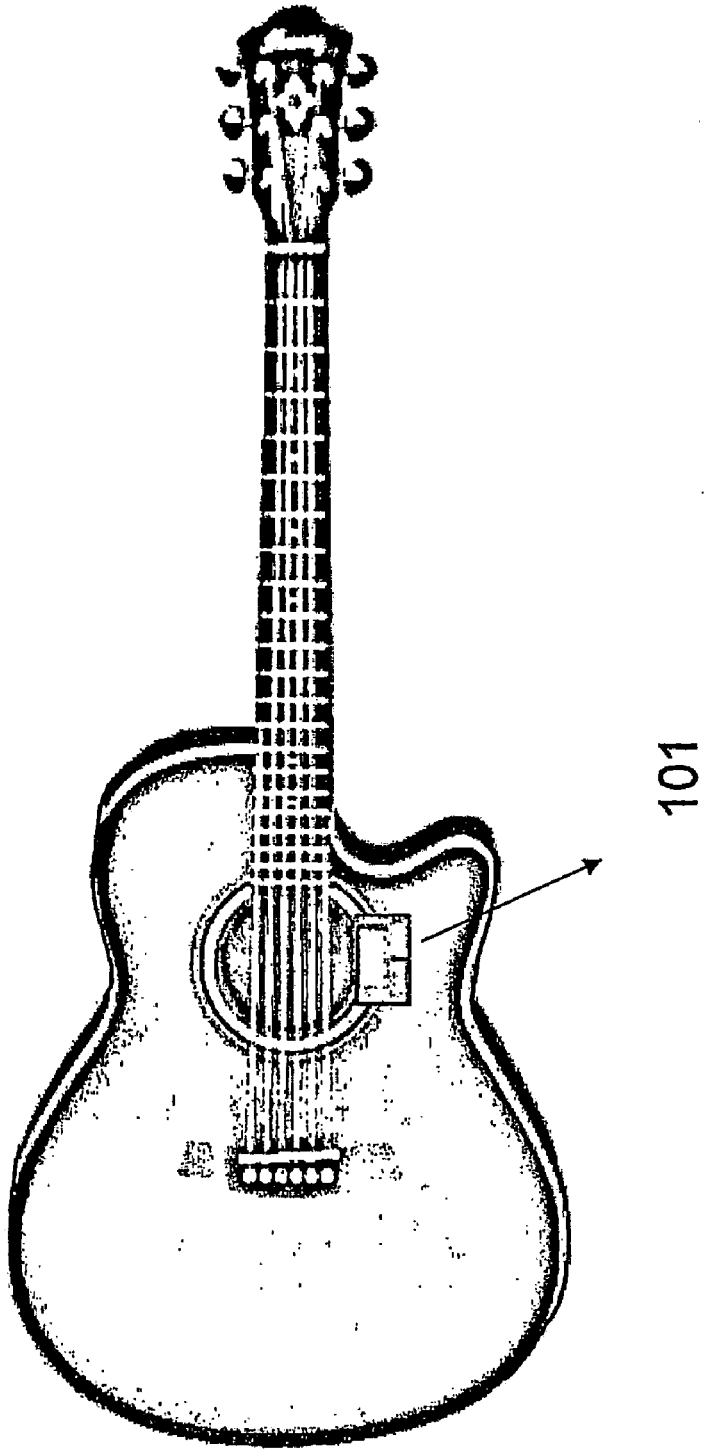
FIG. 8 is an illustration of an acoustic guitar according to the present invention, including a touch-pad DCU.

FIG. 8 is an illustration of an acoustic guitar according to the present invention, including a touch-pad DCU. According to this implementation, the touch pad [101] is mounted upon the lower front panel of the guitar body.

Figure 9:
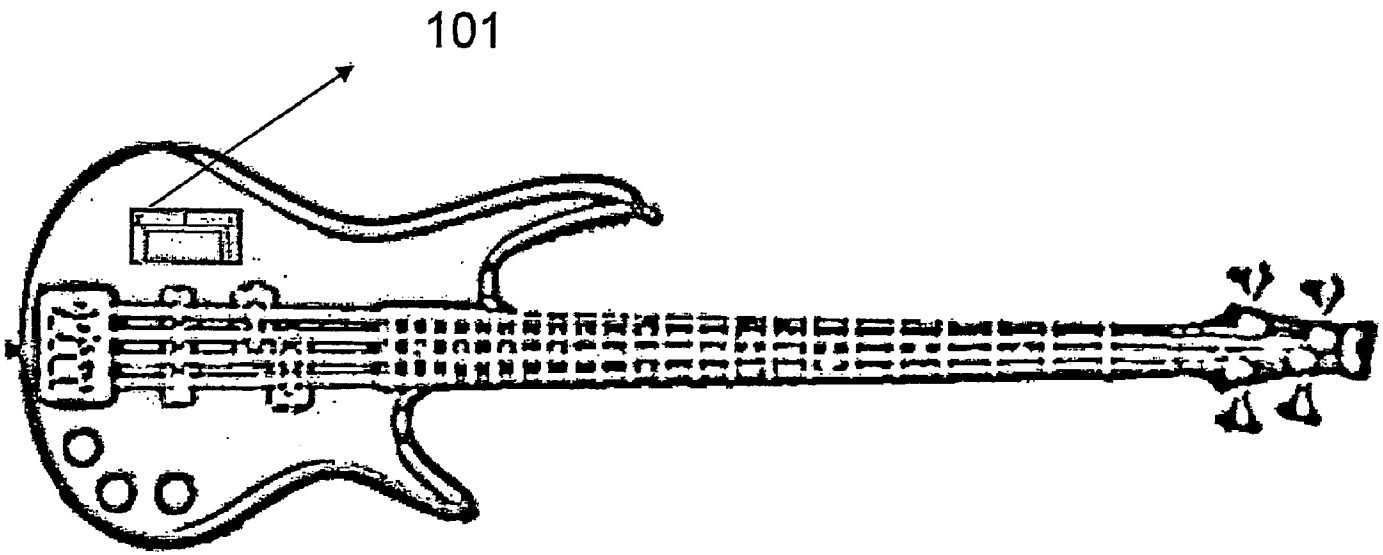
FIG. 9 is an illustration of a bass guitar according to the present invention, including a touch-pad DCU mounted upon the upper front panel of the guitar.

FIG. 9 is an illustration of a bass guitar according to the present invention, including a touch-pad DCU. According to this implementation, the touch pad [101] is mounted upon the upper front panel of the bass guitar body.

Figure 10:
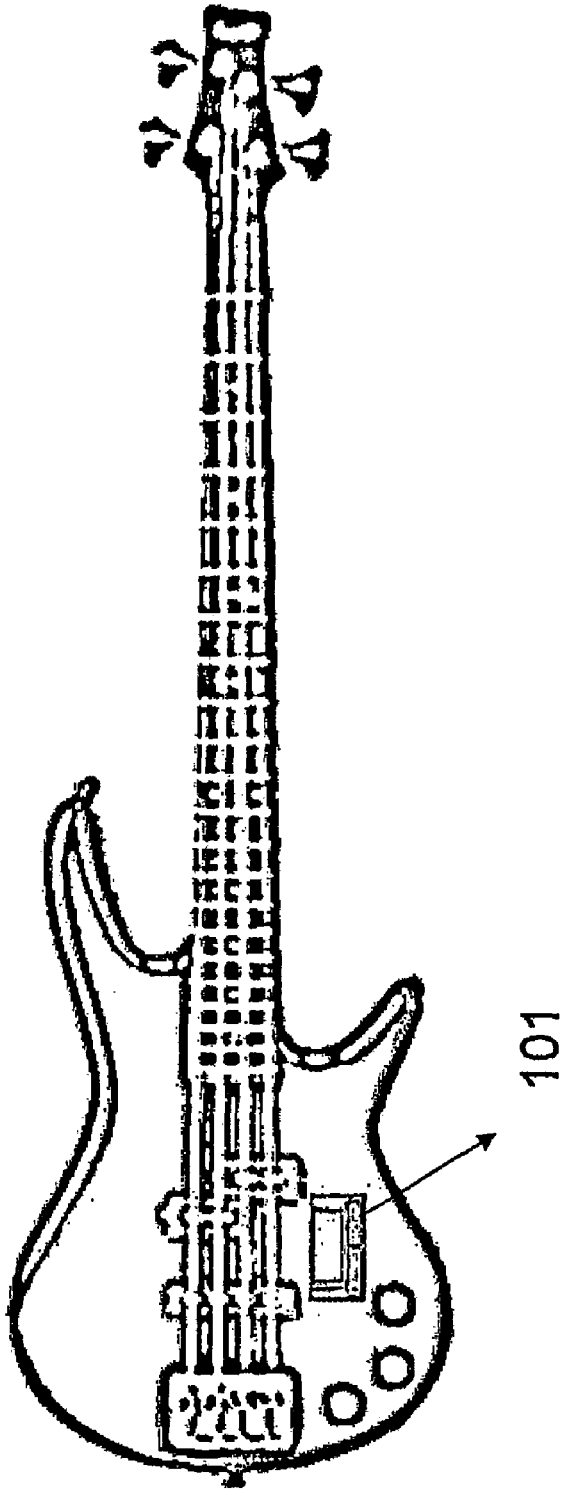
FIG. 10 is an illustration of a bass guitar according to the present invention, including a touch-pad DCU mounted upon the lower front panel of the guitar.

FIG. 10 is an illustration of a bass guitar according to the present invention, including a touch-pad DCU. According to this implementation, the touch pad [101] is mounted upon the lower front panel of the bass guitar body.

Figure 11:
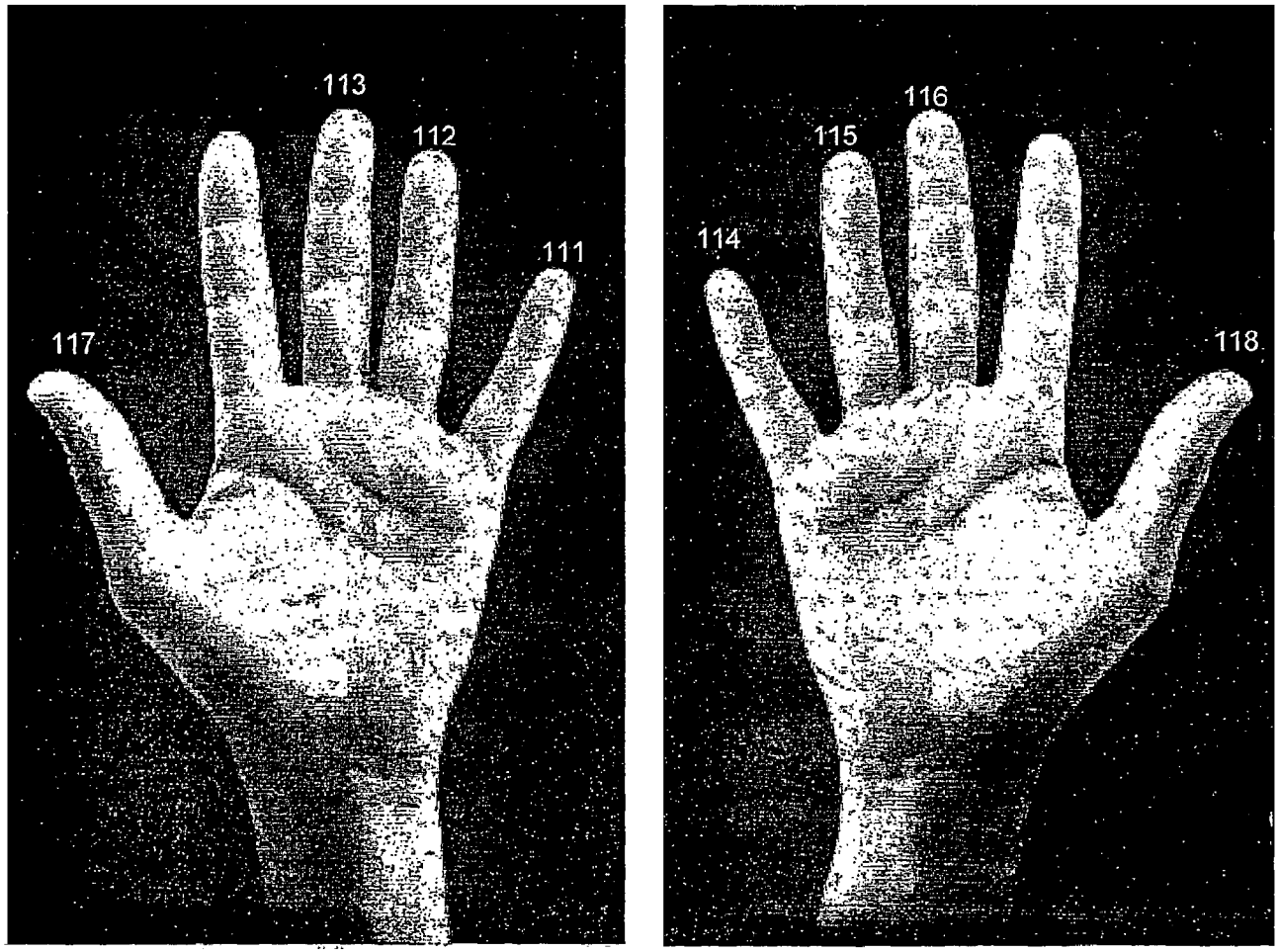
FIG. 11 is an illustration showing the different fingers of the guitar player's left and right hands.

FIG. 11 is an illustration showing the different fingers of the guitar player of his left and right hands. If the guitar player is using his right hand to pluck or strum the guitar string (as is usually done by using right hand guitars), he can use at least one of his right hand fingers defined by the numbers [114], [115] and [116] to operate the DCU. If the guitar player is using his left hand to pluck or strum the guitar string (as is usually done by using left hand guitars), he can use at least one of his left hand fingers defined by the numbers [111], [112] and [113] to operate the DCU. Bass guitar players further use their left [117] and right [118] thumbs for controlling the DCU while using their other fingers (pinky, ring, middle and index) to pluck the strings.

Figure 12:
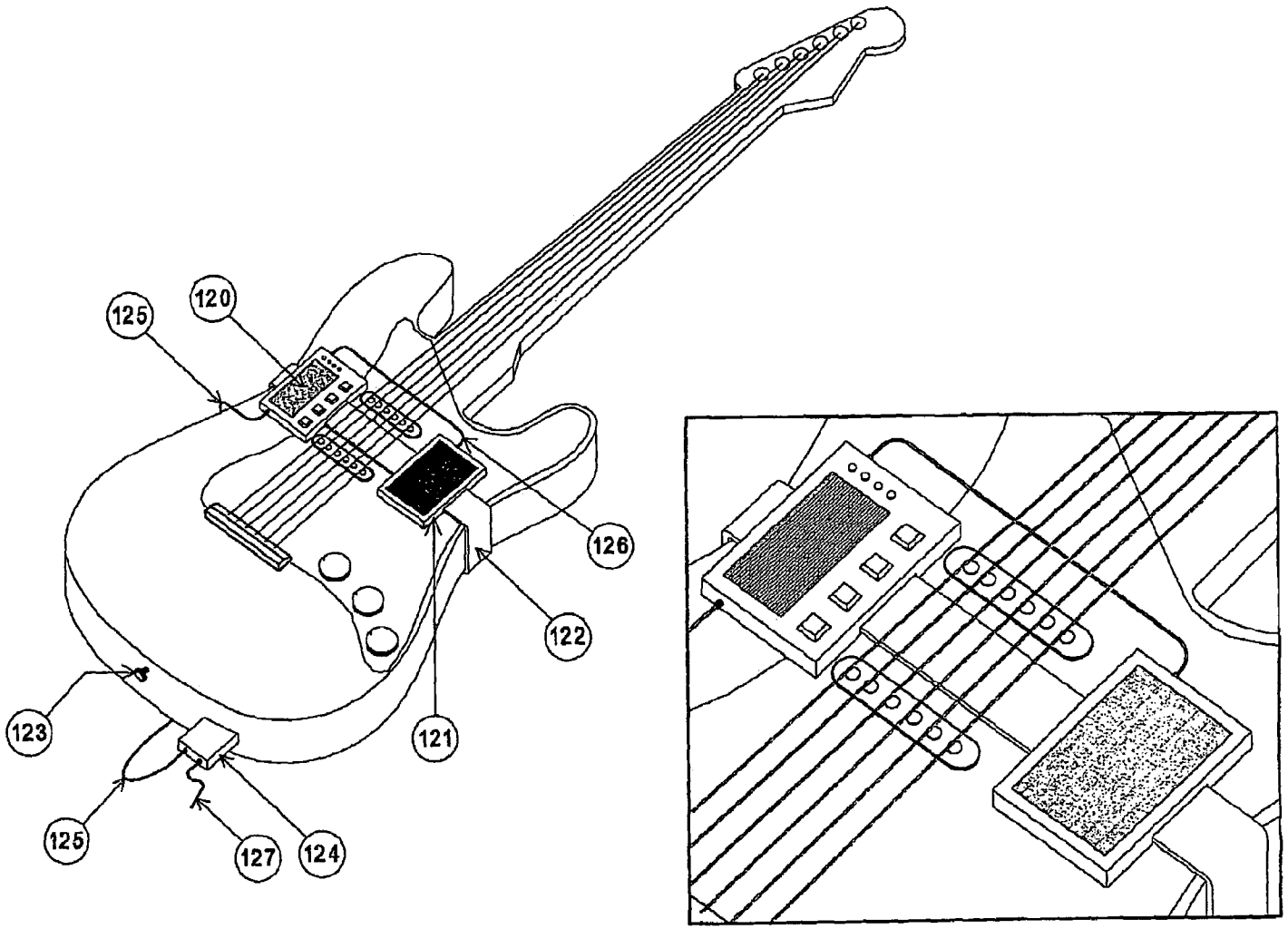
FIG. 12 is an illustration of the manner in which the proposed system's inner components and DCU are mounted upon an electric guitar according to the present invention.

FIG. 12 is an illustration of the manner in which the proposed system's inner components and DCU are mounted upon the guitar according to the present invention. The proposed system's inner components (e.g. SCU, SPU) [120] excluding the DCU are mounted upon the front panel of the guitar's body above the guitar's strings. The DCU [121] is mounted upon the front panel of the guitar beneath the guitar's strings. A strap attachment [122] is provided for attaching said components to the body of the guitar, whereas a cord wire [126] is provided for transmitting control signals between these components. The strap attachment passes under the strings of the guitar and elapses over the guitar's body. The guitar's strap buttons [123] may further be included for fastening and stabilizing the manner in which the strap attachment is applied. A cord wire [125] is provided for enabling a data transmission of the audio signals from the guitar to the system's inner components [120] and vice versa. A splitter [124] enables a dual transmission of said audio signals from the guitar to the proposed system and from the system to the Output Devices (e.g. Guitar Amp.) via an additional cord wire [127].

The mechanism is included for attaching and detaching the DCU to the lower front panel of an amplified guitar and to the upper front panel of a bass guitar. The mechanism is at least one strap attachment, which passes under the guitar's strings in between the guitar's pickups. In the case of a lead electric guitar which contains only one pickup (as in Fender Telecaster guitars) the attachment strap passes besides and along the pickup, thus encompassing the body of the guitar and tightening said dynamic control unit to the front panel of the guitar. The attachment means is provided for connecting/disconnecting the DCU along with at least one of the other system's components as a unit to the front panel of the amplified guitar under the guitar's strings An additional method for applying the strap attachment is by threading it from side to side upon the front panel of the guitar and passing it beneath the guitar's strings in the lower area of the guitar body. Said attachment encompasses the body of the guitar while tightening the DCU to the front panel of the guitar.

The DCU is attached to the strap attachment using a mechanism from the group of: a pin (similar to the mechanism for combining a strap to a hand watch), a clipping device, a dedicated strap pass or slot in the unit, a velcro strap, a rubber band and a scotch tape.

The mechanism may further be implemented as an attachment means from the group of: a clipping device, a velcro strap, glue, vacuum buttons, a rubber band, a scotch tape and bolts.

The multi-sound effect system further comprising a mechanism for attaching the system's components excluding the DCU to the amplified guitar body and to the strap attachment, wherein the mechanism is an attachment means from the group of: a strap, a clipping device, a velcro strap, glue, vacuum buttons and bolts.

In accordance with further improvements of the present invention, it is suggested to provide the player with various options of effect manipulations or combination thereof:

Activating, deactivating specific effect type or types;

Changing the effect type or types;

Activating, deactivating or changing effect patches, which is a combination of several effect types and parameters setting, in which the effect types are combined in a certain order or structure and are played together;

Controlling parameters of effect algorithm which determine the activation pattern of an effect, for example, determining set of time intervals in delay effect according to the time interval between sequential fingers' tapping on a touch-pad DCU;

bypassing or muting an effect;

freezing the values of effect parameters according to last user action or according to predefined settings;

Adjusting the effect parameters values in accordance with predetermined continues or discontinues pattern;

Adjusting the effect parameters values according to a recorded continues or discontinues path of the finger's motion over the DCU or according to recorded or real time finger's tapping on the DCU.

All these effect manipulations can be controlled in real time by the player using different types of DCU of the present invention. For each DCU type the respective modes of operation are used in accordance with the DCU characteristic such as sensitivity to finger's contact, position, pressure and/or movement. The player may control these modes of operation in different ways: by moving the finger in a certain direction, by placing the finger at a specific position, by changing the pressure applied on the DCU, by tapping on the DCU at predetermined or arbitrary time intervals or according to rhythm, by moving the finger along predetermined or arbitrary continues or discontinues path or by removing the fingers from the DCU.

While the above description contains many specifities, these should not be construed as limitations on the scope of the invention, but rather as exemplifications of the preferred embodiments. Those skilled in the art will envision other possible variations that are within its scope. Accordingly, the scope of the invention should be determined not by the embodiment illustrated, but by the appended claims and their legal equivalents.

What is claimed is:

1. A multi-sound effects system for controlling guitar sound-effects comprising:

an amplified guitar that produces electrical audio signals while manipulating strings of the amplified guitar;

a touch-sensitive Dynamic Control Unit operable to measure a plurality of dimensions relating to positioning and pressure of at least one finger of a picking hand on the Dynamic Control Unit and operable to produce a plurality of control signals representing the measured dimensions; and a Signal Processing Unit for processing the electrical audio signals received from the amplified guitar according to the plurality of control signals received from the Dynamic Control Unit, wherein the Dynamic Control Unit is positioned on the amplified guitar proximal to the strings to enable a guitar player to set and adjust in play-time the control signals simultaneously while playing the guitar by moving the at least one finger of the picking hand across said Dynamic Control Unit, and wherein the Signal Processing Unit creates the guitar sound-effects by manipulating and processing the electrical audio signals in accordance with said plurality of control signals.

2. The multi-sound effects system of claim 1 wherein the Dynamic Control Unit is located beneath the guitar strings at a lower front panel of the guitar.

3. The multi-sound effects system of claim 1 wherein the amplified guitar is a bass guitar, wherein the Dynamic Control Unit is attached above the guitar strings at an upper front panel of the bass guitar.

4. The multi-sound effects system of claim 1 wherein the Signal Processing Unit is further enabled to start and stop the activation of the signal processing procedure or process the electrical audio signal in accordance with finger activation of said Dynamic Control Unit, wherein the activation includes at least one of the following: contact, pressure, location or amount of time that the finger is activating the Dynamic Control Unit.

5. The multi-sound effects system of claim 1 wherein the Dynamic Control Unit is touch sensitive to at least one finger's contact, position and pressure, providing at least one three dimensional vector that represent the absolute or relative position and the amount of absolute or relative pressure of the finger on the Dynamic Control Unit.

6. The multi-sound effects system of claim 1 wherein the Dynamic Control Unit is sensitive to the at least one finger's pressure and position, providing at least one scalar or at least one two dimensional vector that represents the absolute or relative position of the finger over the Dynamic Control Unit.

7. The multi-sound effects system of claim 1 wherein the Dynamic Control Unit is sensitive to at least one finger's position movement, providing at least one scalar or at least one two dimensional vector that represent the absolute or relative position of the finger over the Dynamic Control Unit or the measurement of the finger movement over the Dynamic Control Unit.

8. The multi-sound effect system of claim 1 wherein the Dynamic Control Unit is one of the following: a trackball, potentiometer, encoder, at least one push button, joystick, lever, touch pad, touch screen, dynamic ribbon.

9. The multi-sound effects system of claim 1 further comprising components which are at least one of the following units:

a Static Control Unit, which is provided to select the predetermined sound-effect parameters of the SPU, to set the system's mode of operation and to program files regarding the desired effects of the guitar, wherein said Static Control Unit includes a set of buttons and knobs for controlling said parameters;

a Management Unit which includes a processing unit, wherein said Management Unit is provided to handle the system and its functionality;

a Memory Unit which is provided to save and share program files, data files and recorded audio data regarding the operation of the system;

a Signal Conversion Unit, wherein said Signal Conversion Unit includes an Analog-to-Digital Converter for converting the analog audio signals received from the guitar to their digital format as required by said signal processing unit and a Digital-to-Analog Converter for converting the digital audio signals back to their analog format which is transferred to external devices;

an Amplification Unit for adjusting the level of said audio signals;

a Interface Unit which is provided to enable a physical connection between external audio signal sources and the inner system, wherein the physical connection is applied for receiving and transmitting said audio signals;

a Monitor Unit which is provided to give the guitar player relevant information regarding the system's status and its mode of operation;

a Visual Display LED Unit which is provided to give the guitar player relevant information regarding the system's status and its mode of operation;

a Communication Unit which is provided to enable efficient communication between said multi-sound effect system and external systems and enables sharing of data files, program files and audio files;

a Musical Instrument Digital Interface (MIDI) Control Unit provided for controlling and communicating with different instruments and effects supported by MIDI protocols;

a Keyboard Interface Unit for entering data, accessing, selecting and programming said multi sound-effects through external programming devices;

additional units from the group of: a metronome, a drum machine, an MP3 encoder, an MP3 decoder, a guitar tuner, a bass guitar tuner, a sequencer, a chord dictionary, an electrical tablature book.

10. The multi-sound effects system of claim 1 wherein the Dynamic Control Unit is removably mounted upon the body of the guitar.

11. The multi-sound effects system of claim 1 wherein the Dynamic Control Unit is built-in to the body of the guitar.

12. The multi-sound effects system of claim 9 wherein all the system's components excluding the Dynamic Control Unit are built as stand-alone unit which is located outside the guitar body.

13. The multi-sound effects system of claim 9 wherein at least one of the system's components is removably mounted upon the body of the guitar.

14. The multi-sound effect system of claim 9 wherein at least one of the system's components is built-in to the body of the guitar.

15. The multi-sound effects system of claim 9 wherein the connection between the Dynamic Control Unit and at least one of the other system's components is a wireless connection.

16. The multi-sound effects system of claim 9 wherein the connection between the signal processing unit and at least one of the other system's components is a wireless connection.

17. The multi-sound effects system of claim 9 wherein the connection between the Dynamic Control Unit, the Signal Processing Unit and the other system's components is a wired connection.

18. The multi-sound effects system of claim 1 wherein the adjustment of the control signals is achieved in accordance with at least one of the following: a continuous or discontinuous pattern, a recorded continuous or discontinuous path of the finger's motion over the Dynamic Control Unit, a recorded or real time finger's tapping on the Dynamic Control Unit.

19. The multi-sound effects system of claim 1 further enabling at least one effect manipulation operation from the list of: activating/deactivating specific effect, changing the effect type, activating/deactivating or changing an effect patch, controlling parameters of effect algorithm which determine the activation pattern of an effect, bypassing or muting an effect, freezing the values of effect parameters according to last user action or according to predefined settings.

20. The multi-sound effects system of claim 19 wherein effect patch is a combination of several effect types and parameters setting, in which the effect types are combined in a certain order or structure and are played together.

21. The multi-sound effects system of claim 19 wherein the effect manipulation operation can be controlled by the user by at least one of the following mode of operation: by moving the finger in a certain direction, by placing the finger at a specific position, by changing the pressure applied on the Dynamic Control Unit, by tapping on the Dynamic Control Unit at predetermined or arbitrary time intervals or according to rhythm, by moving the finger along predetermined or arbitrary continuous or discontinuous path or by removing the fingers from the Dynamic Control Unit.

* * * * *